US011817072B2

(12) United States Patent
Ellis

(10) Patent No.: US 11,817,072 B2
(45) Date of Patent: Nov. 14, 2023

(54) SYSTEMS AND METHODS FOR ONBOARD, REAL-TIME PICKUP BLENDING FOR ELECTRIC GUITARS AND BASSES

(71) Applicant: Mark Ellis, Cypress, TX (US)

(72) Inventor: Mark Ellis, Cypress, TX (US)

( * ) Notice: Subject to any disclaimer, the term of this patent is extended or adjusted under 35 U.S.C. 154(b) by 0 days.

(21) Appl. No.: 17/588,513

(22) Filed: Jan. 31, 2022

(65) Prior Publication Data

US 2023/0049331 A1 Feb. 16, 2023

Related U.S. Application Data

(63) Continuation of application No. 17/397,627, filed on Aug. 9, 2021, now Pat. No. 11,276,381.

(51) Int. Cl.

| | |
|---|---|
| ***G10H 3/18*** | (2006.01) |
| ***G10H 1/08*** | (2006.01) |
| ***G10D 15/00*** | (2006.01) |
| ***G10D 1/08*** | (2006.01) |
| ***G10H 1/14*** | (2006.01) |

(52) U.S. Cl.

CPC ..... *G10H 3/186* (2013.01); *G10D 1/08* (2013.01); *G10D 15/00* (2013.01); *G10H 1/08* (2013.01); *G10H 1/14* (2013.01); *G10H 3/181* (2013.01); *G10H 3/182* (2013.01); *G10H 3/185* (2013.01); *G10H 2210/311* (2013.01); *G10H 2210/565* (2013.01); *G10H 2220/515* (2013.01)

(58) Field of Classification Search

CPC ..... G10H 3/18; G10H 2220/525; G10H 1/00; G10H 1/46; G10H 3/181; G10H 3/182; G10H 2220/505; G10H 2220/515; G10H 1/18; G10H 3/185; G10H 2220/465; G10H 2220/461

See application file for complete search history.

(56) References Cited

U.S. PATENT DOCUMENTS

| | | | | |
|---|---|---|---|---|
| 5,866,834 | A | 2/1999 | Burke et al. | |
| 9,747,882 | B1 | 8/2017 | Micek | |
| 11,276,381 | B1 * | 3/2022 | Ellis | G10H 1/08 |
| 2006/0011051 | A1 | 1/2006 | Aivbrosino | |
| 2021/0151022 | A1 * | 5/2021 | Hoover | H03F 3/187 |

FOREIGN PATENT DOCUMENTS

GB 2470581 A 12/2010

* cited by examiner

*Primary Examiner* — Marlon T Fletcher
(74) *Attorney, Agent, or Firm* — Kirby Drake

(57) ABSTRACT

Systems and methods for onboard, real-time pickup blending for electric guitars/basses may utilize every possible tonal combination that double coil pickups can offer. The industry standard pickup toggle switch may be removed from electric guitar/bass instruments. Instead of a user being limited to only using one pickup at a time to be selected, the user may mix in any combination of the pickups (top, bottom, or both) at any time. Accordingly, multiple pickups can be on at the same time and/or the user may blend in (or out) any percentage of any of the pickups that the user wishes to create a large combination of tones.

14 Claims, 7 Drawing Sheets

Series Wiring = Standard Wiring for Humbucker Pickups (two single coil pickups wired together in series to create a tone).

Parallel Wiring = Splits Humbucker into two Single Coil Pickups, but wires them together in parallel, essentially making it sound like ONE Single Coil Pickup, but at 2x the volume.

SYSTEMS AND METHODS FOR ONBOARD, REAL-TIME PICKUP BLENDING FOR ELECTRIC GUITARS AND BASSES

CROSS-REFERENCE TO RELATED APPLICATION

The present application is a continuation of U.S. patent application Ser. No. 17/397,627 filed Aug. 9, 2021, the disclosure of which is incorporated by reference in its entirety.

FIELD OF THE DISCLOSURE

The present disclosure generally relates to electric guitar and bass pickups, and more particularly to onboard, real-time pickup blending for electric guitars and basses.

BACKGROUND

Typically, in order to provide the tones needed to record and/or perform music, multiple guitars and/or basses need to be used. More specifically, a guitarist has to utilize different guitars to get all of the desired tones. Each guitar uses a variation of different pickup combinations. A guitar will use a pickup selector switch so the user can "select" which pickup from which to output tones. Industry standard pickup selector switches include: a 5-way selector, a 3-way selector, and on/off switches. The different pickup layout types were made popular by these main iconic guitars: Stratocaster®, Telecaster®, and Gibson Les Paul®.

SUMMARY

Embodiments of the present disclosure may provide for onboard, real-time pickup blending for electric guitars/basses that may utilize every possible tonal combination that double coil pickups can offer. Embodiments of the present disclosure may remove the industry standard pickup toggle switch from electric guitar/bass instruments. Instead of a user being limited to only using one pickup at a time to be selected, embodiments of the present disclosure may allow the user to mix in any combination of the pickups (top, bottom, or both) at any time. Accordingly, multiple pickups can be on at the same time and/or the user may blend in (or out) any percentage of any of the pickups that the user wishes to create a large combination of tones.

Embodiments of the present disclosure may provide a system for onboard, real-time pickup blending for electric guitars/basses comprising two separate options: coil splitting or series/parallel wiring. Coil splitting may include at least two double coil (Humbucker) pickups, each of the at least two double coil pickups including: a three-way toggle switch to select a tonal characteristic of the pickup; and an off/on blender knob capable of blending sound from the pickup from 0-100% to a final mix; a master volume knob; and a master tone knob.

In another embodiment, a series/parallel option may include a two-way toggle switch to select how the coils within a double coil pickup may be wired (in series versus in parallel), and an on/off blender knob capable of blending sound from the pickup from 0-100% to a final mix; a master volume knob, and a master tone knob.

In both embodiments, the master volume knob may be a 500k Ohm potentiometer. The master tone knob may be a 500k Ohm potentiometer. For coil splitting, the tonal characteristic may be selected from the following: North single coil only, series, or South single coil only. The off/on blender knob may be a 500k Ohm potentiometer. The at least two double coil pickups may comprise at least a neck pickup; a middle pickup; and a bridge pickup. For series/parallel, the tonal characteristic may be selected from the following: both coils within the double coil pickup wired as series or wired as parallel.

A neck pickup blender knob may be off (0%), a middle pickup blender knob may be off (0%), a bridge pickup blender knob may be on (100%), and a bridge pickup toggle switch may be set to middle to create a Gibson Les Paul Rock sound. The neck pickup blender knob and/or the middle pickup blender knob may be capable of being adjusted up in percentage to color a tone to cut through a mix. A neck pickup blender knob may be on (100%), a middle pickup blender knob may be off (0%), a bridge pickup blender knob may be off (0%), and a neck pickup toggle switch may be set to down to create a lead guitar tone. A neck pickup blender knob may be on (100%), a middle pickup blender knob may be off (0%), a bridge pickup blender knob may be on (100%), a neck pickup toggle switch may be set to down, and a bridge pickup toggle switch may be set to middle to create a combination of a Gibson Les Paul Rock sound and a lead guitar tone. The neck pickup blender knob and/or the bridge pickup blender knob may be capable of being adjusted down in percentage to make the combination less bright. The three-way toggle switch of each of the at least two double coil pickups may be adjustable in real time. The off/on blender knob of each of the at least two double coil pickups may be adjustable in real time. Each of the at least two double coil pickups, the master volume knob, and the master tone knob may be provided on a printed circuit board.

Other technical features may be readily apparent to one skilled in the art from the following figures, descriptions and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Embodiments of the present disclosure may provide for a user to mix in any combination of pickups (whether coil splitting through top, bottom, or both or series/parallel) at any time through use of a selector or toggle switch. The selector or toggle switch may allow a desired one or more of multiple pickups to be selected and placed in either a parallel or series configuration as described herein. Accordingly, multiple pickups can be on at the same time and/or the user may blend in (or out) any percentage of any of the pickups that the user wishes to create a large combination of tones. More specifically, a user may use a selector or toggle switch to select a pickup type (whether coil splitting through top/North, both, or bottom/South or series/parallel wiring) and then identify whether the output should be on or off and/or what percentage of output (0-100%) should be utilized (such as through use of a knob or other similar selection mechanism). Accordingly, through the use of the above-described selection mechanisms, multiple pickups can be on at the same time and/or the user may blend in (or out) any percentage of any of the pickups that the user wishes to create a large combination of tones.

Embodiments of the present disclosure may provide scalable wiring, and in some embodiments of the present disclosure, a minimum of two double coil (also known as Humbucker) pickups may be used. In an example, a guitar may include a master volume knob (500k Ohm potentiometer) and a master tone knob (500k Ohm potentiometer). These potentiometers may be utilized to control tone and volume for modifying the sound provided by the guitar/bass in embodiments of the present disclosure.

With each pickup, there may be a two or three-way toggle switch that may allow the user to select the tonal characteristics of the pickup in question (i.e., coil splitting through North Coil only (North Single Coil) or South Coil only (South Single Coil); series/parallel through coils wired in series or wired in parallel). A 500k Ohm potentiometer may act as an off/on blender knob. This may allow the user to blend in the sound from the pickup anywhere from 0-100% to the final mix.

Figure 1:
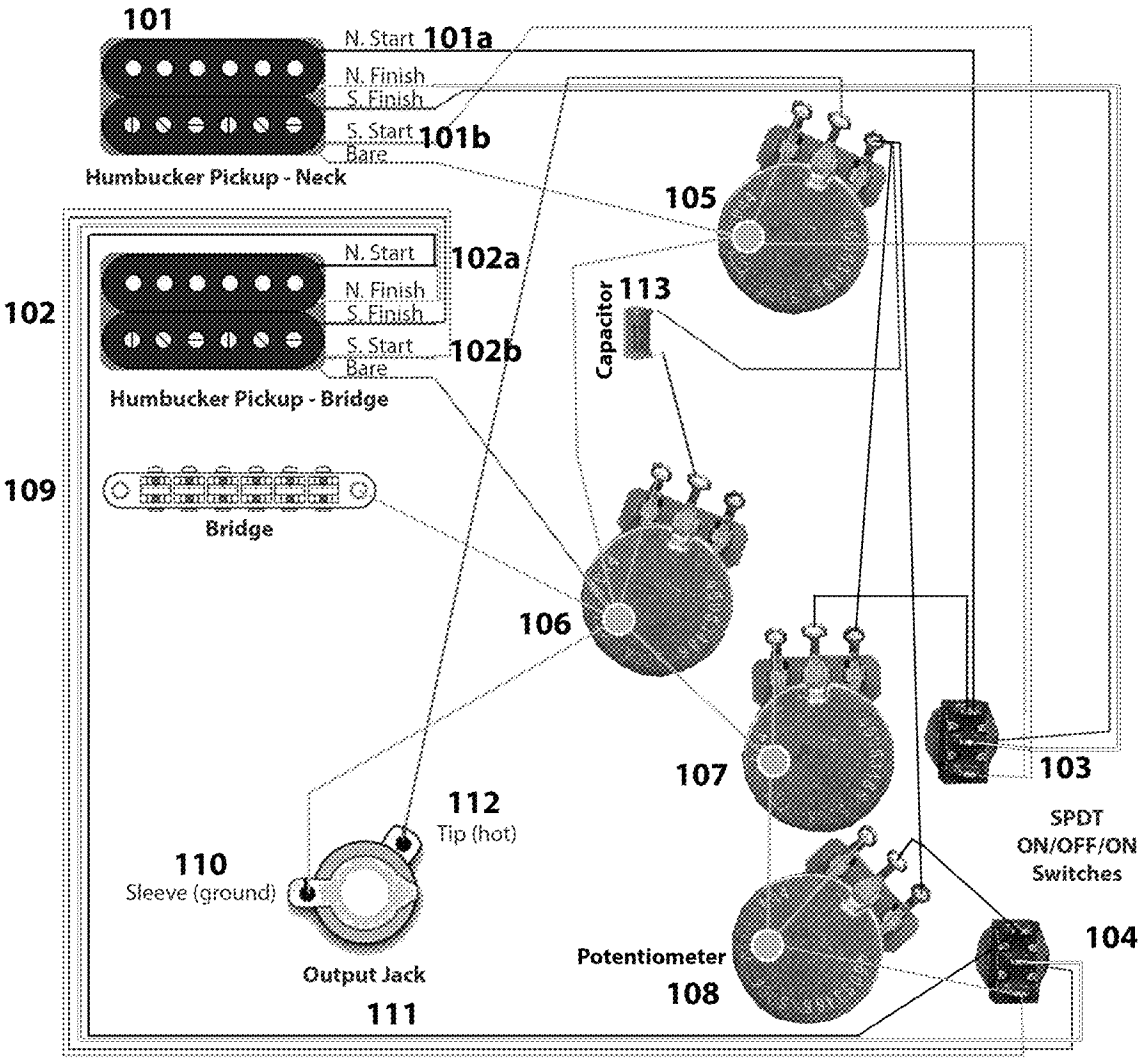
FIG. 1 depicts a wiring diagram for a pickup volume knob version according to an embodiment of the present disclosure.

FIG. 1 depicts a wiring diagram for a pickup volume knob version of the coil splitting option according to an embodiment of the present disclosure. As depicted herein, a two-pickup version is provided with a double coil (North coil and South coil) pickup for the neck 101 and a double coil (North coil and South coil) pickup for the bridge 102. The start wire for the North coil 101*a* of the double coil pickup for the neck 101 and the start wire for the South coil 101*b* of the double coil pickup for the neck 101 each may be connected to first single pole double throw (SPDT) switch 103. The start wire for the North coil 101*a* may run from first SPDT switch 103 to first 500K Ohm potentiometer 105. The start wire for the South coil 101*b* may run from first SPDT switch 103 to third potentiometer 107. The start wire for the North coil 102*a* of the double coil pickup for the bridge 102 and the start wire for the South coil 102*b* of the double coil pickup for the bridge 102 each may be connected to second single pole double throw (SPDT) switch 104. The start wire for the North coil 102*a* may run from second SPDT switch 104 to fourth potentiometer 108. The start wire for the South coil 102*b* also may run from second SPDT switch 104 to fourth potentiometer 108.

Bridge 109 also is depicted in FIG. 1 and may be connected to second potentiometer 106 which may then be connected in with first potentiometer 105, third potentiometer 107, and ground sleeve 110 provided on output jack 111. Ground sleeve 110 is the inner, circular portion of output jack 111. Output jack 111 also may include tip 112, which may be considered a hot output of output jack 111. Tip 112 may be wired to first potentiometer 105. Third potentiometer 107 and fourth potentiometer 108 may be connected to one another as well as depicted in FIG. 1. A 3.3K Ohm connection may be provided between first potentiometer 105 and third potentiometer 107. Another 3.3K Ohm connection may be provided between first potentiometer 105 and fourth potentiometer 108. Capacitor 113, such as a 0.0022 F capacitor, may be provided between first potentiometer 105 and second potentiometer 106.

Figure 2A:
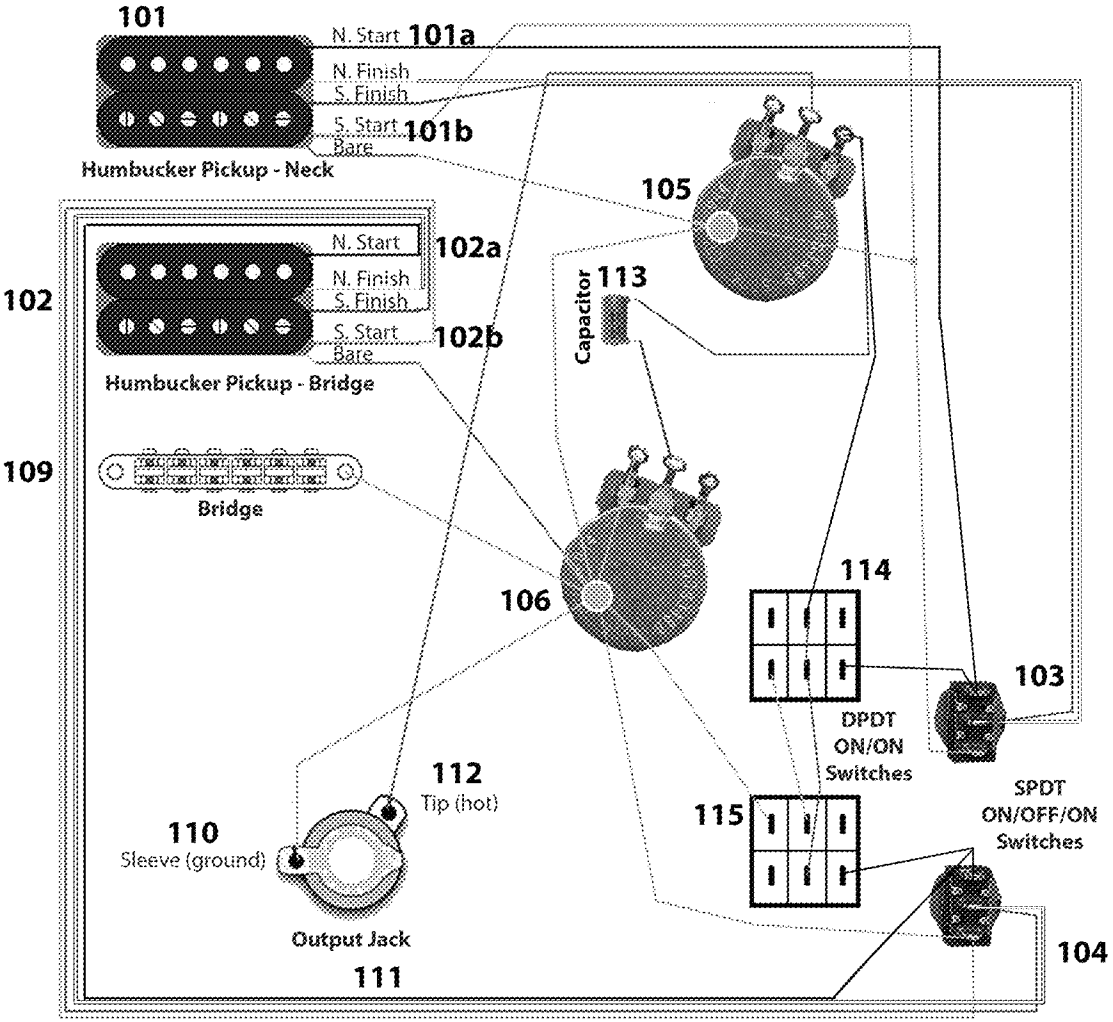
FIGS. 2A-2B depicts a wiring diagram for a pickup on/off toggle version according to an embodiment of the present disclosure.

FIG. 2A depicts a wiring diagram for a pickup on/off toggle version of the coil splitting option according to an embodiment of the present disclosure. As depicted herein, a two-pickup version is provided with a double coil (North coil and South coil) pickup for the neck 101 and a double coil (North coil and South coil) pickup for the bridge 102. The start wire for the North coil 101*a* of the double coil pickup for the neck 101 and the start wire for the South coil 101*b* of the double coil pickup for the neck 101 each may be connected to first single pole double throw (SPDT) switch 103. The start wire for the North coil 101*a* may run from first SPDT switch 103 to first double pole double throw (DPDT) switch 114. The start wire for the South coil 101*b* may run from first SPDT switch 103 to second potentiometer 106. The start wire for the North coil 102*a* of the double coil pickup for the bridge 102 and the start wire for the South coil 102*b* of the double coil pickup for the bridge 102 each may be connected to second single pole double throw (SPDT) switch 104. The start wire for the North coil 102*a* may run from second SPDT switch 104 to second DPDT switch 115. The start wire for the South coil 102*b* also may run from second SPDT switch 104 to second potentiometer 106.

Bridge 109 also is depicted in FIG. 2A and may be connected to second potentiometer 106 which may then be connected in with first potentiometer 105 and ground sleeve 110 provided on output jack 111, as a ground circuit. Ground sleeve 110 is the inner, circular portion of output jack 111. Output jack 111 also may include tip 112, which may be considered a hot output of output jack 111. Tip 112 may be wired to first potentiometer 105. Capacitor 113, such as a 0.0022 F capacitor, may be provided between first potentiometer 105 and second potentiometer 106.

Figure 3A:
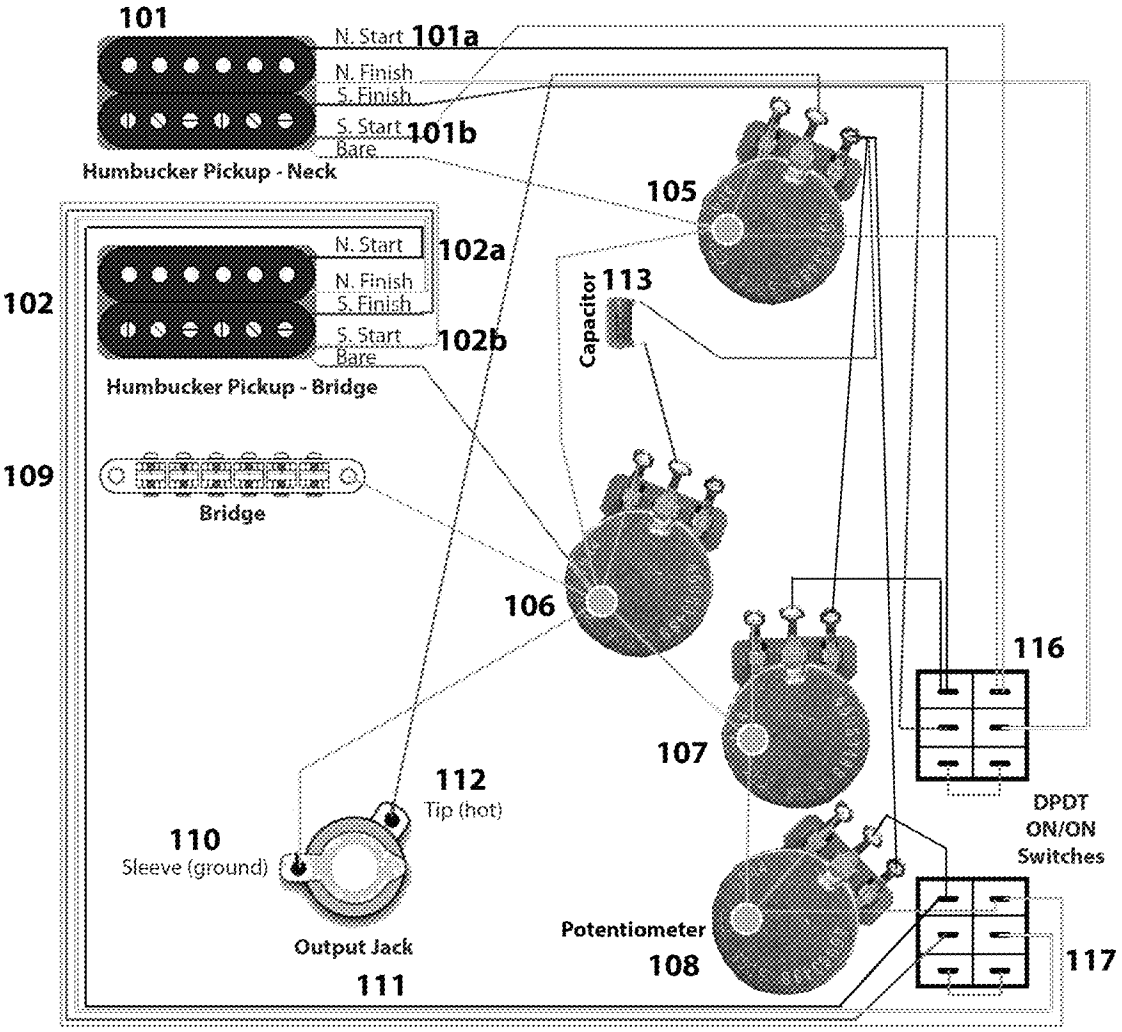
FIGS. 3A-3B depicts another wiring diagram of the series/parallel option according to an embodiment of the present disclosure.
Figure 3B:
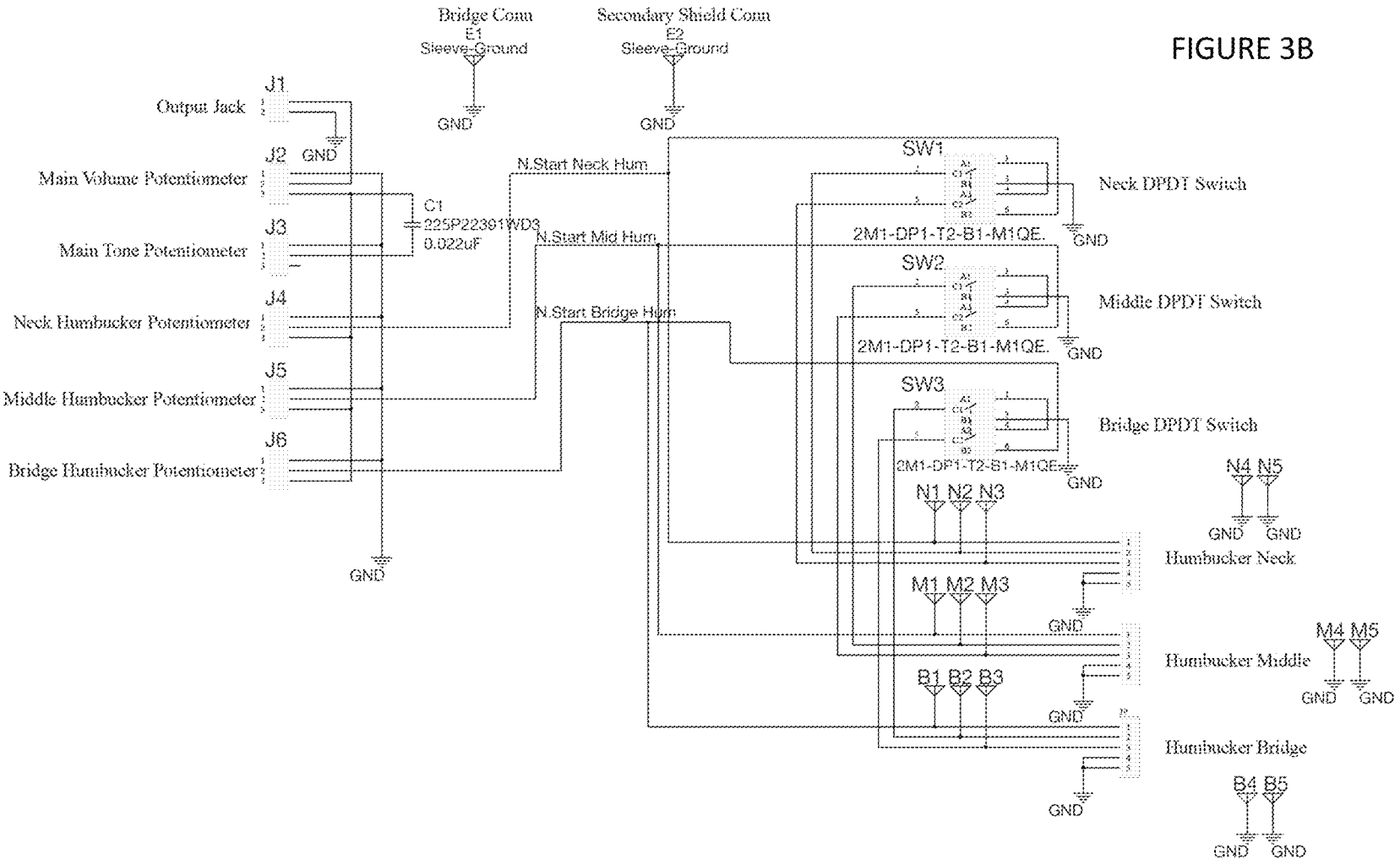

FIGS. 3A-3B depicts another wiring diagram of the series/parallel option according to an embodiment of the present disclosure. As depicted herein, a two-pickup version is provided with a double coil (North coil and South coil) pickup for the neck 101 and a double coil (North coil and South coil) pickup for the bridge 102. The start wire for the North coil 101*a* of the double coil pickup for the neck 101 and the start wire for the South coil 101*b* of the double coil pickup for the neck 101 each may be connected to first double pole double throw (DPDT) on/off switch 116. The start wire for the North coil 101*a* may then run from first DPDT on/off switch 116 to third potentiometer 107, and the start wire for the South coil 101*b* may then run from first DPDT on/off switch 116 to first potentiometer 105. The start wire for the North coil 102*a* of the double coil pickup for the bridge 102 and the start wire for the South coil 102*b* of the double coil pickup for the bridge 102 each may be connected to second DPDT switch 117. The start wire for the North coil 102*a* may run from second DPDT switch 117 to fourth potentiometer 108. The start wire for the South coil 102*b* also may run from second DPDT switch 117 to fourth potentiometer 108.

Bridge 109 also is depicted in FIG. 3A and may be connected to second potentiometer 106 which may then be connected in with first potentiometer 105, third potentiometer 107, and ground sleeve 110 provided on output jack 111. Tip 112 may be wired to first potentiometer 105. Capacitor 113, such as a 0.0022 F capacitor, may be provided between first potentiometer 105 and second potentiometer 106. Third potentiometer 107 and fourth potentiometer 108 may be connected to one another as well as depicted in FIG. 3A. A 3.3K Ohm connection may be provided between first potentiometer 105 and third potentiometer 107. Another 3.3K Ohm connection may be provided between first potentiometer 105 and fourth potentiometer 108.

In an embodiment of the present disclosure, a user may use a configuration similar to that depicted below in order to create the multiple tones. If a Gibson Les Paul Rock sound is required, the user may set the configuration to the following:

| | |
|---|---|
| Neck Pickup Toggle Switch: | — |
| Neck Pickup Knob: | Off (0%) |
| Middle Pickup Toggle Switch: | — |
| Middle Pickup Knob: | Off (0%) |
| Bridge Pickup Toggle Switch: | Middle |
| Bridge Pickup Knob: | On (100%) |

If a lead guitar tone was needed, such as with a Fender Stratocaster, the user may set the configuration to the following:

| | |
|---|---|
| Neck Pickup Toggle Switch: | Down |
| Neck Pickup Knob: | On (100%) |
| Middle Pickup Toggle Switch: | — |
| Middle Pickup Knob: | Off (0%) |
| Bridge Pickup Toggle Switch: | — |
| Bridge Pickup Knob: | Off (0%) |

If a combination of both the tones above is desired, the user may set the configuration to the following:

| | |
|---|---|
| Neck Pickup Toggle Switch: | Down |
| Neck Pickup Knob: | On (100%) |
| Middle Pickup Toggle Switch: | — |
| Middle Pickup Knob: | Off (0%) |
| Bridge Pickup Toggle Switch: | Middle |
| Bridge Pickup Knob: | On (100%) |

If this combination ended up sounding too bright, the user may dial down one of the pickups using the following configuration:

| | |
|---|---|
| Neck Pickup Toggle Switch: | Down |
| Neck Pickup Knob: | On (25%) |
| Middle Pickup Toggle Switch: | — |
| Middle Pickup Knob: | Off (0%) |
| Bridge Pickup Toggle Switch: | Middle |
| Bridge Pickup Knob: | On (100%) |

Another application of use according to embodiments of the present disclosure may be at a live concert. A guitarist uses various effects and volume pedals to achieve different tonal changes live in real time. By giving the ability to turn on or off other pickup tones on the fly in real time, a guitarist could easily change their tone without the need of other external effects. One example would be if a guitarist is playing a Rhythm guitar part using configuration:

| | |
|---|---|
| Neck Pickup Toggle Switch: | — |
| Neck Pickup Knob: | Off (0%) |
| Middle Pickup Toggle Switch: | — |
| Middle Pickup Knob: | Off (0%) |
| Bridge Pickup Toggle Switch: | Middle |
| Bridge Pickup Knob: | On (100%) |

Once the song needs a change in tone for the guitar (i.e., a solo, lead part, or just something that needs to cut through the mix), the guitarist could just turn on another pickup slightly in order to color the tone a little more so that it will cut though the mix. A configuration such as the following may achieve this tone:

| | |
|---|---|
| Neck Pickup Toggle Switch: | Down |
| Neck Pickup Knob: | On (25%) |
| Middle Pickup Toggle Switch: | — |
| Middle Pickup Knob: | Off (0%) |
| Bridge Pickup Toggle Switch: | Middle |
| Bridge Pickup Knob: | On (100%) |

As reflected in the above embodiments, configurations according to embodiments of the present disclosure are not limited to on/off output. Rather, values from 0-100% of any pickup may be blended using any configuration of the pickup. This may provide a variety of new tonal options that have not been previously possible.

Figure 4:
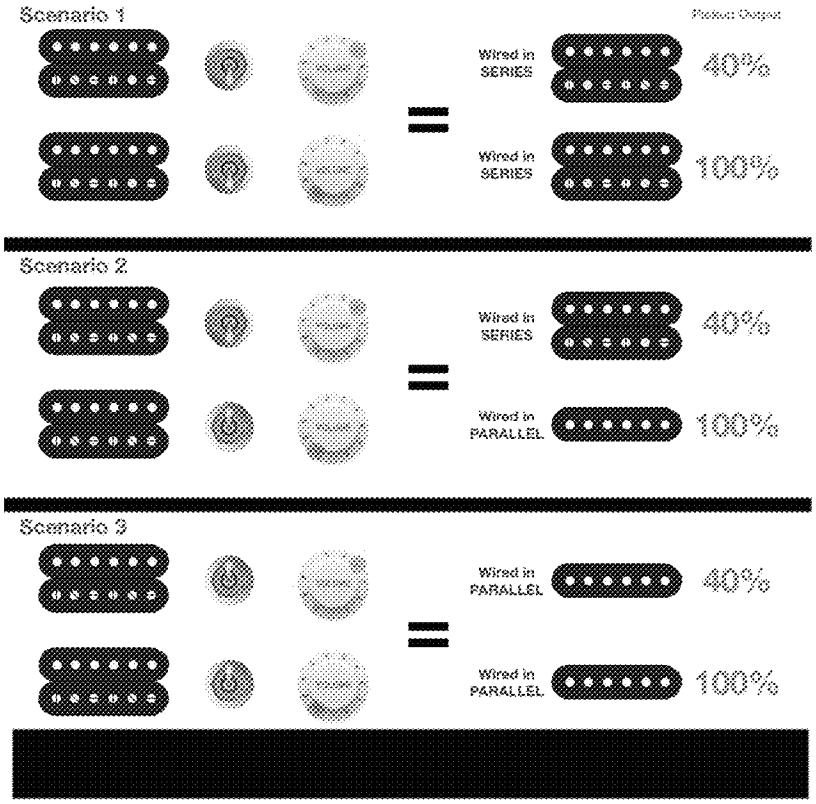
FIG. 4 depicts different wiring scenarios according to an embodiment of the present disclosure.

FIG. 4 depicts different wiring scenarios according to an embodiment of the present disclosure. In each of these scenarios, a pickup selector or toggle switch may be provided along with an output knob for each pickup to be provided on the guitar/bass. The output knob may be used for adjustment of volume and/or tone according to embodiments of the present disclosure. Volume control may allow a user to vary the volume of the instrument while tone control may allow the use to vary the tone of the instrument.

As reflected herein, there may be some scenarios where series and/or parallel wiring may be utilized. Series wiring refers to standard wiring for double coil pickups (i.e., two single coil pickups wired together in series to create a tone). Parallel wiring splits a double coil pickup into two single coil pickups but wires them together in parallel, essentially making it sound like one single coil pickup but at twice the volume. Scenario 1 depicts two pickups each wired in series but one with a pickup output of 40% and the other having a pickup output of 100%. Scenario 2 depicts two pickups—one wired in series having a pickup output of 40% and the other wired in parallel having a pickup output of 100%. Scenario 3 depicts two pickups each wired in parallel but one with a pickup output of 40% and the other having a pickup output of 100%.

Figure 2B:
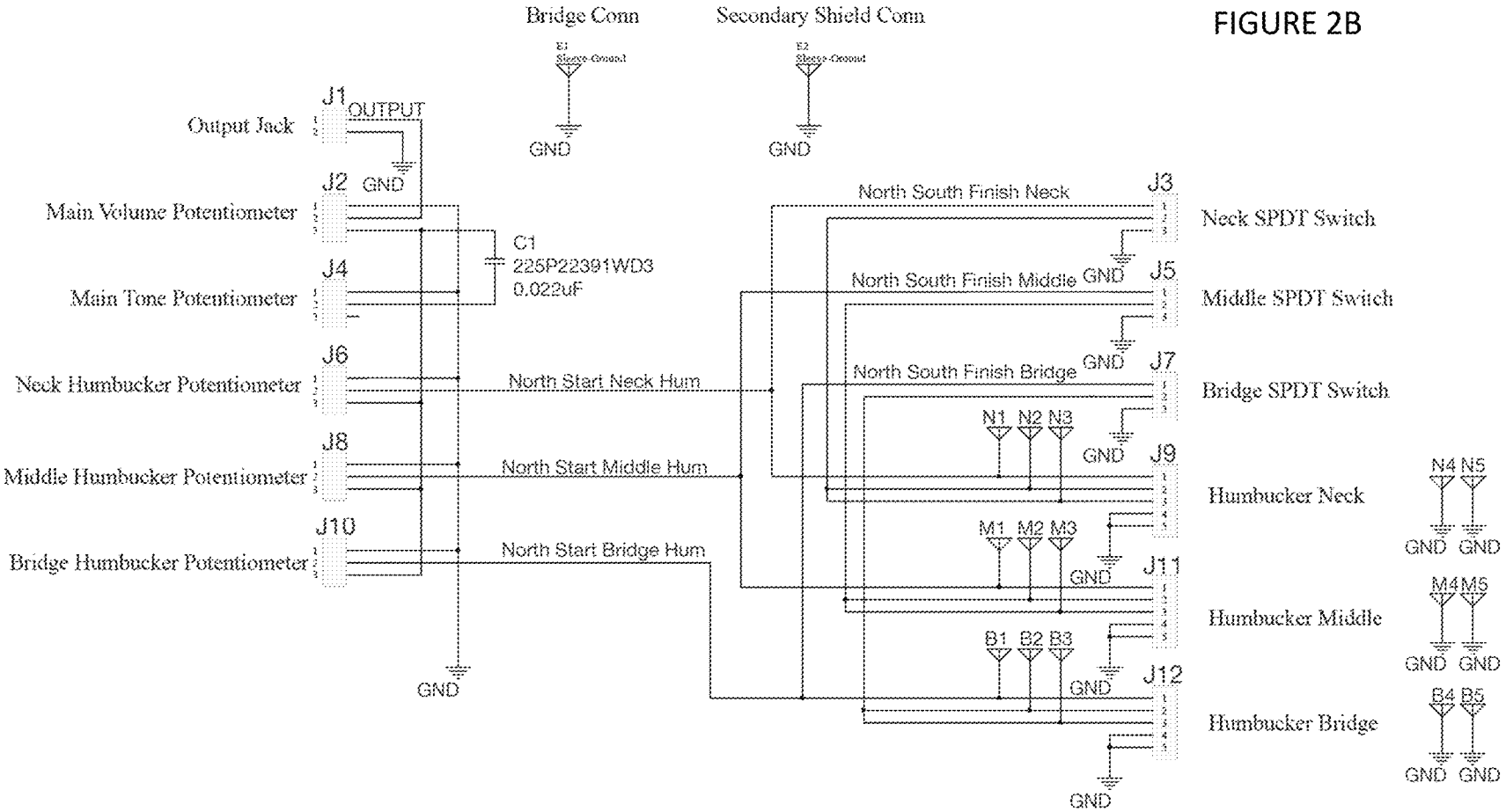
Figure 5B:
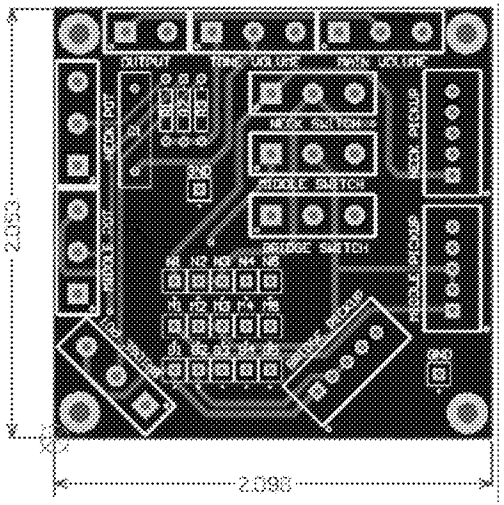
FIGS. 5A-5C depict printed circuit boards (PCBs) to replace the wiring of FIGS. 1-3 according to an embodiment of the present disclosure.
Figure 5A:
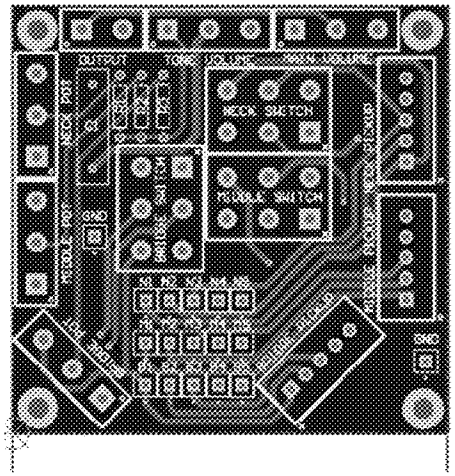
Figure 5C:
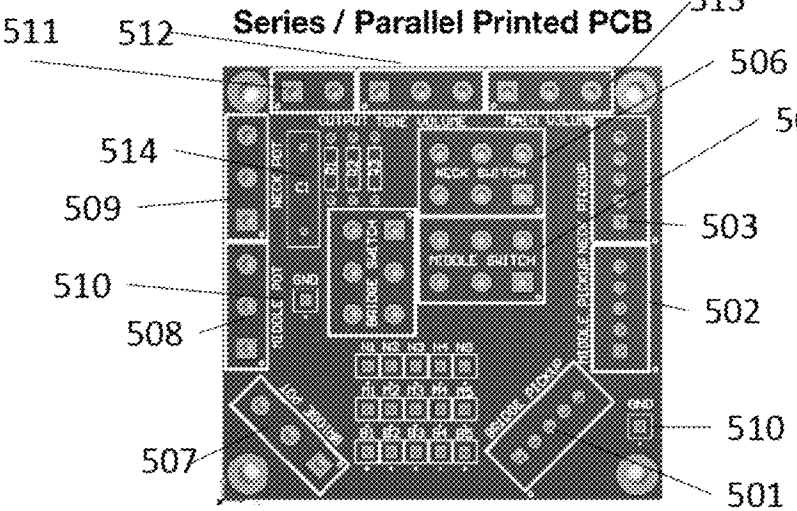

While FIGS. 1-3 depict wiring that may be utilized for configurations according to embodiments of the present disclosure, it should be appreciated that printed circuit boards (PCBs) may be used in place of the wiring. FIGS. 5A-5C depict printed circuit boards (PCBs) to replace the wiring of FIGS. 1-3 according to an embodiment of the present disclosure. As depicted herein, a modular design may be provided using a PCB and screw terminal quick disconnects (solderless). More specifically, FIG. 5A depicts a series to parallel wiring for a PCB according to an embodiment of the present disclosure. FIG. 5B depicts coil splitting wiring for a PCB according to an embodiment of the present disclosure.

FIG. 5C depicts a series to parallel printed PCB according to an embodiment of the present disclosure. As depicted herein, the PCB may include bridge pickup 501, middle pickup 502, and neck pickup 503. The PCB also may include bridge switch 504, middle switch 505, and neck switch 506. The PCB may further include bridge potentiometer 507, middle potentiometer 508, and neck potentiometer 509. At least one ground (GND) 510 also may be provided along with output 511, tone volume 512, main volume 513, and capacitor 514 in embodiments of the present disclosure. Test pads N1-5, M1-5 and B1-5 may allow for quick testing of the continuity between each of the five wires for each pickup (i.e., neck (N1-N5), middle (M1-M5), and bridge (B1-B5). R1-R3 represent the resisters needed for each pickup: R1 for neck, R2 for middle, and R3 for bridge. The connections between the various components on the PCB depicted in FIG. 5C are depicted in FIGS. 5A-5B. While certain connections are depicted herein, there may be other connections without departing from the present disclosure.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A system for onboard, real-time pickup blending for electric guitars/basses comprising:

at least two double coil (Humbucker) pickups selected from a neck pickup, a middle pickup, and a bridge pickup, each of the pickups including:

a three-way toggle switch adjustable in real-time to select a tonal characteristic of the associated selected pickup, where the tonal characteristic is selected from the following:

North single coil only, or South single coil only, and series or parallel wiring of the coils; and an off/on blender knob adjustable in real-time and capable of blending sound from the associated selected pickup from 0-100% to a final mix, wherein the system is housed on the same electric guitar or bass to provide onboard, real-time pickup blending, the system allowing for mixing in any combination of pickups residing on the same electric guitar or bass at the same time, and wherein no additional components are required to alter the tonal characteristics digitally.

2. The system of claim 1 further comprising:

a master volume knob.

3. The system of claim 2 wherein the master volume knob is a potentiometer.

4. The system of claim 1 further comprising:

a master tone knob.

5. The system of claim 4 wherein the master tone knob is a potentiometer.

6. The system of claim 1 wherein the off/on blender knob is a potentiometer.

7. The system of claim 1, wherein a neck pickup blender knob is off (0%), a middle pickup blender knob is off (0%), a bridge pickup blender knob is on (100%), and a bridge pickup toggle switch is set to middle to create a Gibson Les Paul Rock sound.

8. The system of claim 1, wherein the neck pickup blender knob and/or the middle pickup blender knob is capable of being adjusted up in percentage to color a tone to cut through a mix.

9. The system of claim 1, wherein a neck pickup blender knob is on (100%), a middle pickup blender knob is off (0%), a bridge pickup blender knob is off (0%), and a neck pickup toggle switch is set to down to create a lead guitar tone.

10. The system of claim 1, wherein a neck pickup blender knob is on (100%), a middle pickup blender knob is off (0%), a bridge pickup blender knob is on (100%), a neck pickup toggle switch is set to down, and a bridge pickup toggle switch is set to middle to create a combination of a Gibson Les Paul Rock sound and a lead guitar tone.

11. The system of claim 10, wherein the neck pickup blender knob and/or the bridge pickup blender knob are capable of being adjusted down in percentage to make the combination less bright.

12. A system for onboard, real-time pickup blending for electric guitars/basses comprising:

a double coil neck pickup including a two-way toggle switch to select how coils are wired and an off/on blender knob adjustable in real-time and capable of blending sound from the pickup from 0-100% to a final mix;

a double coil middle pickup including a two-way toggle switch to select how coils are wired and an off/on blender knob adjustable in real-time and capable of blending sound from the pickup from 0-100% to a final mix; and a double coil bridge pickup including a two-way toggle switch to select how coils are wired and an off/on blender knob adjustable in real-time and capable of blending sound from the pickup from 0-100% to a final mix, wherein the system is housed on the same electric guitar or bass to provide onboard, real-time pickup blending; and wherein each of the two-way toggle switches select tonal characteristics of its respective pickup selected from coil splitting through top/North, bottom/South, or both, and series/parallel through coils wired in series or in parallel.

13. The system of claim 12 further comprising:

a master volume knob.

14. The system of claim 12 further comprising:

a master tone knob.

* * * * *